United States Patent [19]

Chin

[11] Patent Number: 4,913,805

[45] Date of Patent: Apr. 3, 1990

[54] APPARATUS AND METHOD FOR FROTH FLOTATION

[75] Inventor: Ti-Hua Chin, Voorhees, N.J.

[73] Assignee: BP America Inc., Cleveland, Ohio

[21] Appl. No.: 314,442

[22] Filed: Feb. 23, 1989

[51] Int. Cl.[4] ..... B03D 1/14

[52] U.S. Cl. ..... 209/164; 209/168; 209/10; 210/703; 210/776

[58] Field of Search ..... 209/164, 168, 169, 170, 209/172, 172.5, 173, 10; 210/703, 776, 523, 525, 526

[56] References Cited

U.S. PATENT DOCUMENTS

| | | | |
|---|---|---|---|
| 1,301,532 | 4/1919 | Allen | 209/168 |
| 2,833,411 | 5/1958 | Bosman | 209/172.5 |
| 3,204,773 | 9/1965 | Lind | 210/526 |
| 4,156,648 | 5/1979 | Kuepper | 209/170 |
| 4,347,126 | 8/1982 | McGarry | 209/168 |
| 4,347,127 | 8/1982 | Duttera | 209/168 |

FOREIGN PATENT DOCUMENTS

| | | | |
|---|---|---|---|
| 460894 | 7/1969 | U.S.S.R. | 209/169 |

*Primary Examiner*—David L. Lacey
*Assistant Examiner*—Thomas M. Lithgow
*Attorney, Agent, or Firm*—Dilworth & Barrese

[57] ABSTRACT

An improved apparatus and method for froth flotation of particulate matter is disclosed wherein ridges or ribs are provided on the froth discharge surface of the apparatus.

12 Claims, 2 Drawing Sheets

APPARATUS AND METHOD FOR FROTH FLOTATION

BACKGROUND OF THE INVENTION

This invention relates to a method and apparatus for flotation separation and more particularly to a method and apparatus for froth flotation separation and beneficiation of carbonaceous matter and mineral ores.

Froth flotation operates to separate finely ground valuable carbonaceous matter or minerals from their associated gangue. In general, the frothing process is carried out by introducing air into a pulp of finely divided carbonaceous matter or mineral ore in water containing a frothing or foaming agent whereby a froth is formed. The carbonaceous particles or minerals with a specific affinity for air bubbles rise to the surface in the froth and are thus separated from the gangue wetted by the water.

Conventional prior art processes for froth flotation separation of a slurry of particulate matter typically include those based on constructions wherein air is introduced into the liquid slurry of the particulate matter as, e.g., through a porous cell bottom or a hollow impeller shaft, thereby producing a surface froth.

Improved methods and apparatus for carrying out froth flotation separation of coal and other minerals are disclosed in U.S. Pat. No. 4,347,126 and U.S. Pat. No. 4,347,127. These patents disclose a flotation apparatus wherein a primary spray nozzle is positioned above the flotation tank for spraying input slurry, such as particulate coal or mineral ore into the tank and a recycle spray nozzle is positioned above the tank for respraying particulate matter collected in a collection trough positioned in the tank for collection sinking material.

In operation of the afore-described improved flotation method and apparatus, a froth is created on the liquid surface in the cell or tank in which a substantial quantity of desired particulate matter is floating. Typically, in order to remove the froth from tank or cell and thereby collect the froth, a skimming arrangement, e.g., skimmer plates, skim the froth on the liquid surface toward a discharge surface, typically upwardly inclined, extending from the liquid surface to a collection tank arranged at one side of the flotation apparatus. The skimmer plates skim the froth from the liquid surface up the inclined discharge surface and into the collection tank. A recognized problem associated with this type of skimming arrangement, however, is that the skimmers carry excessive undesirable mineral-laden water along with the froth which decreases the froth grade.

SUMMARY OF THE INVENTION

Accordingly, it is one object of the present invention to provide an improved method and apparatus for froth flotation separation of a slurry of particulate matter.

It is another object of the present invention to provide an improved method and apparatus for the froth flotation and beneficiation of carbonaceous matter, such as coal, or mineral ores.

Still another object of the invention is to provide a method and apparatus for froth flotation separation of a slurry which in operation provide improved yields of clean product by improving the grade of the collected froth.

These and other objects are achieved herein by providing an apparatus for froth flotation separation of the components of a slurry having particulate matter therein which is to be separated, said apparatus comprising:

a flotation tank having means for removing a floating fraction, said means for removing said floating fraction including a discharge surface, said discharge surface having at least one ridge or rib disposed thereon over which said floating fraction is passed.

Other objects of the present invention are accomplished herein by providing a method for the froth flotation separation of the components of a slurry, said method comprising the steps of:

(i) spraying input slurry of particulate matter into a liquid contained in a flotation tank to create a froth on the liquid surface;

(ii) removing the froth from said liquid surface and passing said froth over a discharge surface, said discharge surface having at least one ridge disposed thereon whereby excessive liquid carried with the froth is separated from said froth prior to collection of the froth.

DETAILED DESCRIPTION OF THE INVENTION

The method and apparatus of the present invention are suitable for the separation of a wide variety of solid-fluid streams by the creation of a solids containing froth phase and thereby suitable for the separation and beneficiation of many types of solid particulate matter. Thus, while the present invention is readily applicable to the froth flotation separation and beneficiation of many types of solids, including mineral ores, the invention is particularly well suited to the froth flotation separation and beneficiation of carbonaceous matter, such as coal.

Accordingly, while the present invention is disclosed herein with particular reference to coal, the froth flotation separation of particulate matter, such as mineral ores, mineral dressings, fines, mine tailings, oil shale, waste particulates and the like are also within the scope of the present invention.

Figure 1:
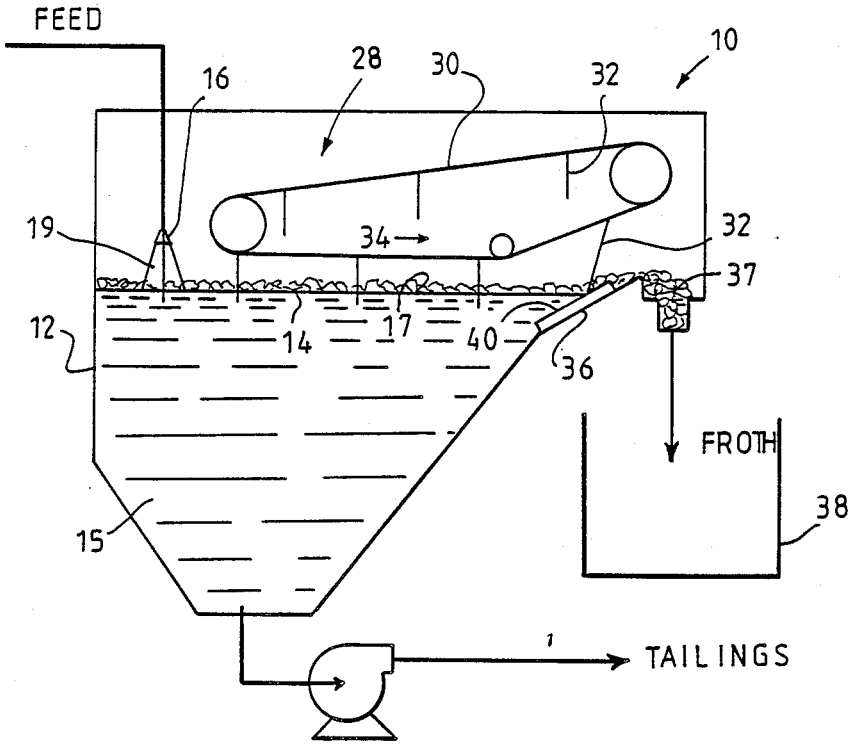
FIG. 1 is a cross-sectional view of a flotation tank useful in accordance with the present invention.

Referring to the drawings herein in greater detail, FIG. 1 illustrates an embodiment 10 of the present invention comprising a flotation tank 12 filled with water 15 to level 14. In operation, a slurry of finely ground coal particles, associated impurities, and if desired additional additives, such as chemical monomer, chemical catalysts, frothing agents and/or fluid hydrocarbons, e.g. fuel oil, such as any or all of the additives disclosed in U.S. Pat. Nos. 4,304,573 and 4,412,843 (incorporated herein by reference), is sprayed through at least one primary feed spray nozzle 16 positioned at a spaced apart distance above the liquid level in tank 12. In alternative embodiments, two or more nozzles can be used to spray slurry and/or any other desired ingredients into the tank.

Figure 3:
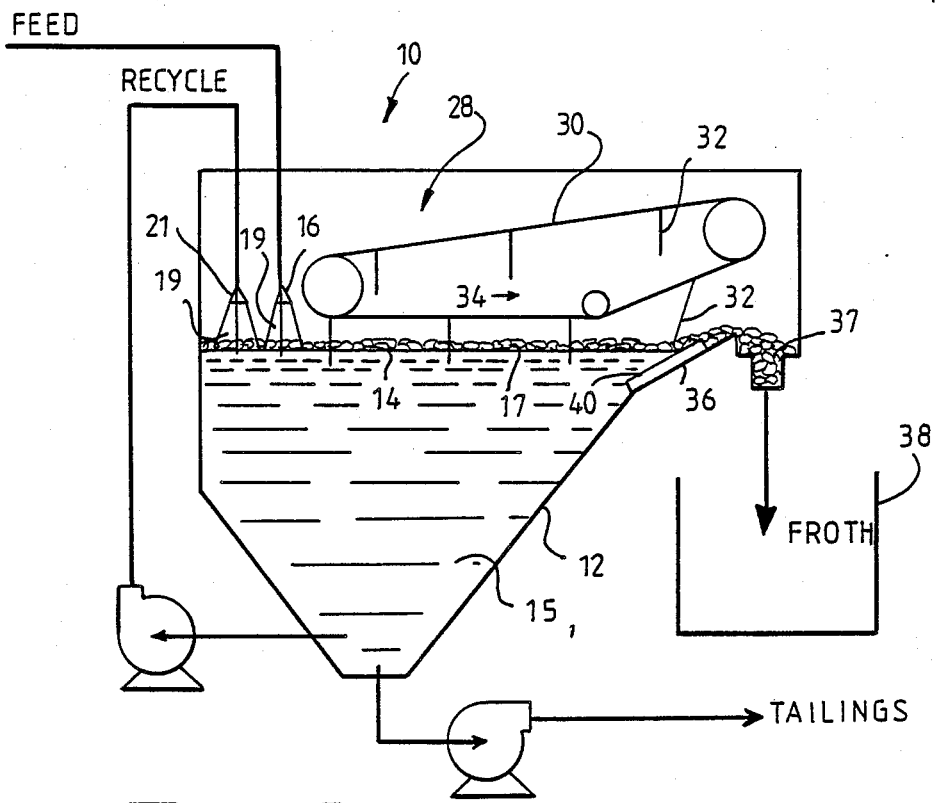
FIG. 3 is a cross-sectional view of another flotation tank, showing a recycle feature, useful in accordance with the present invention.

The stream of treated coal is typically pumped under pressure through a manifold to the spray nozzle 16 wherein the resultant shearing forces spray the coal flocculent slurry as fine droplets such that they are forcefully jetted into the mass of a continuous water bath 15 in tank 12 to form a froth 17. High shearing forces are created in nozzle 16, and the dispersed particles forcefully enter the surface of the water and break up the coal-oil-water flocs thereby water-wetting and releasing ash from the interstices between the coal flocs so that exposed ash surfaces introduced into the water are separated from the floating coal particles and sink into the water bath 15. The surfaces of the finely divided coal particles now contain air sorbed in the atomized particles, much of which is entrapped by spraying the slurry through an aeration zone 19 such that air is sorbed in the sprayed slurry. The combined effects on the treated coal cause the flocculated coal to decrease in apparent density and to float as a froth 17 on the surface of the water bath. The hydrophilic ash remains in the bulk water phase 15, and tends to settle downwardly in tank 12 under the influence of gravity. Tailings, including waste ash and other impurities are removed from the bottom of the tank as illustrated in FIGS. 1 and 3. The flotation tank can also include somewhat standard equipment, which is not illustrated in the drawings, such as a liquid level sensor and control system and a temperature sensing and control system.

The coal particles in the floating froth 17 created by nozzle 16 are removed from the water surface by, e.g., a skimming arrangement 28, in which an endless conveyor belt 30 carries a plurality of spaced skimmer plates 32 depending therefrom. The skimmer plates are pivotally attached to the conveyor belt to pivot in two directions relative to the belt, and the bottom run of the belt is positioned above and parallel to the water surface in the tank. The plates 32 skim the resultant froth on the water surface in a first direction 34 toward an upwardly inclined froth discharge surface 36 to a collection chute 37 and into the froth collection tank 38.

Figure 2:
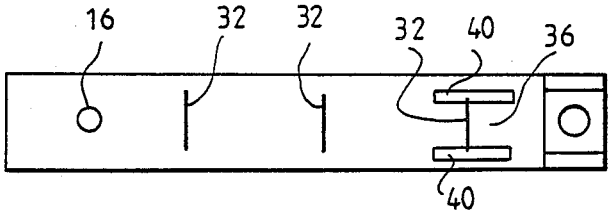
FIG. 2 is a top view of the tank of FIG. 1 showing an upwardly inclined ramp, i.e., discharge surface having ridges over which froth is passed prior to collection in a froth tank.
Figure 4:
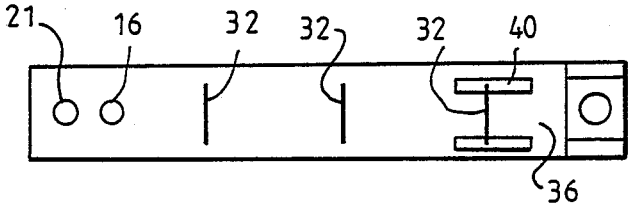
FIG. 4 is a top view of the tank of FIG. 3, showing the upwardly inclined discharge surface having ridges over which froth is passed prior to collection in a froth tank.

In accordance with the specific improvement of the present invention, discharge surface 36 is provided with at least one and preferably two or more fixed ridges or ribs, 40. It has been surprisingly found herein that these ridges or ribs 40 prevent the skimmers from carrying excessive impurity-laden water with the froth thereby providing a cleaner froth. Furthermore, since the ridges or ribs provide the mechanism for the skimmers to collect essentially only froth, the skimmers can be operated to move the froth as quickly as the froth is generated thereby providing for a flotation process having a high yield and production rate. As illustrated in FIGS. 1 and 3, the ridges or ribs 40 are located on the upwardly inclined discharge surface 36 and each ridge or rib 40 extends from below the surface of the water to slightly above the surface of the water in the tank 12. For example, as illustrated in FIGS. 1 and 3, the ridge or rib 40 extends from the commencement of upwardly inclined discharge surface 36 which is below the level of the water in tank 12 to a point slightly above the surface of the water, e.g., several inches above the water level 14. The precise number of and distance between the ridges or ribs 40 on the discharge surface 36 may vary. As seen from FIGS. 2 and 4, the ridges or ribs 40 keep the skimmer plates 32 from riding directly on the surface of discharge surface 36. Excessive water which is carried with the froth by the skimmer plate 32 which passes over the ridges or ribs 40 flows back into the flotation tank. The ridges or ribs 40 may form an integral part of discharge surface 36 such as, for example, discharge surface 36 may take the form of a corrugated surface, or ridges or ribs 40 may be provided, for example, by rods welded or otherwise secured to discharge surface 36.

Spray nozzle 16 may be a hollow jet nozzle as is commercially available from Spraying Systems Co., Wheaton, Illinois. Preferred spray nozzles are the spiral, open flow nozzles disclosed in U.S. Pat. No. 4,514,291 and U.S. Pat. No. 4,650,567, both of which are incorporated by reference herein. Such nozzles are commercially available from Bete Fog Nozzle, Inc., Greenfield, Mass. Of course, it is contemplated herein that other types of nozzles, which function to provide the desired results as hereinbefore described, may also be used. The spray nozzles employed in the practice of the present invention are preferably constructed of stainless steel, ceramic or other suitable hard metal to avoid erosion by the various particles in the slurry pumped therethrough. The nozzles are preferably supplied with slurry in the supply manifolds at a pressure in the range of 5 to 40 psi, and more preferably in a pressure range of 7 to 20 psi.

Each nozzle 16 may be tilted at an angle with respect to a vertical, (i.e., the position of the nozzle relative to the liquid surface level), such that is functions to direct the flow of froth in a direction towards the skimmer arrangement 28. However, the angle of incidence does not appear to be critical, and the vertical positioning shown in FIGS. 1 and 3 may be preferred to create a condition most conducive to agitation and froth generation at the water surface. It appears to be significant that the agitation created by the nozzle sprays define a zone of turbulence extending a limited distance beneath the water surface level. Too much turbulence may actually reduce the amount of frothing produced at the water surface. Among other means, the depth of the turbulence zone may be adjusted by varying the supply pressure of the slurry in the supply manifolds and also the distance of the nozzles above the water surface.

In one operation utilizing the present invention, a recycling technique may be employed to further improve the efficiency. In the recycling technique, particles which do not float after being sprayed through a spray nozzle 16, designated a primary spray nozzle in context with this embodiment, are recycled to a recycle spray nozzle 21 to provide the particles a second opportunity for recovery. Such a recycling technique is disclosed in U.S. Pat. No. 4,347,127 the contents of which are incorporated herein by reference. A pump functions to draw settling materials which are pumped under pressure to the recycle spray nozzle(s) 21. At least one recycle spray nozzle 21, which may be the same type of nozzle as primary spray nozzle 16, is provided above the tank for respraying into the surface of the water bath the sinking materials which are collected such that particles are recycled and a portion of the recycled particles floats as a froth on the water surface an additional time and are recovered. The recycle spray nozzle 21 is positioned in proximity to the primary spray nozzle 16. In alternative embodiments further stages of recycling may be provided by adding additional recycle nozzles to the tank.

While several embodiments and variations of a method and apparatus for froth flotation separation of the components of a slurry have been described in detail herein, it should be apparent that the teachings and disclosure herein will suggest many other embodiments and variations to those skilled in this art.

What is claimed is:

1. Apparatus for froth flotation separation of the components of a slurry having particulate matter therein which is to be separated and collected, said apparatus comprising:

a flotation tank for containing a quantity of liquid, said flotation tank having means for removing a floating fraction, said means for removing said floating fraction including a skimmer means and a discharge surface, said discharge surface having at least one raised ridge means disposed on said discharge surface for preventing said skimmer means from contacting the portion of said discharge surface upon which said at least one raised ridge means is disposed, said at least one raised ridge means cooperating with the skimmer means and discharge surface to separate excess liquid from the floating fraction, said skimmer means functioning to pass said floating fraction over said at least one raised ridge means and over said discharge surface prior to the collection of said floating fraction.

2. The apparatus of claim 1 having a spray means positioned above said flotation tank for spraying a slurry of particulate matter into said flotation tank.

3. The apparatus of claim 1 wherein said skimmer means comprises at least one skimmer plate adapted to operate along the top of said flotation tank.

4. The apparatus of claim 1 wherein said discharge surface is an upwardly inclined surface extending from said flotation tank.

5. The apparatus of claim 1 wherein said tank contains said quantity of liquid and said at least one raised ridge means disposed on said discharge surface extends from a point below the level of liquid contained in said tank to a point above the level of said liquid contained in said tank.

6. Apparatus for froth flotation separation of the components of a slurry having particulate matter therein which is to be separated and collected, said apparatus comprising:

(i) a flotation tank for containing a quantity of liquid;

(ii) means for feeding a slurry of particulate matter into said flotation tank comprising at least one spray nozzle positioned above said flotation tank;

(iii) means for removing a floating fraction from said flotation tank, said means for removing said floating fraction including a skimmer means adapted to operate along the top of said flotation tank and an upwardly inclined discharge surface extending from said flotation tank, said upwardly inclined discharge surface having at least one raised ridge means disposed thereon for preventing said skimmer means from contacting the portion of said discharge surface upon which said at least one raised ridge means is disposed, said at least one raised ridge means cooperating with the skimming means and discharge surface to separate excess liquid from the floating fraction, said skimmer means adapted to skim said floating fraction over said at least one raised ridge means and over said discharge surface prior to the collection of said floating fraction.

7. The apparatus of claim 6 wherein said skimmer means includes a plurality of spaced skimmer plates whereby the skimmer plates skim froth over said at least one raised ridge means disposed on said upwardly inclined discharge surface.

8. The apparatus of claim 6 wherein said tank contains said quantity of liquid and said at least one raised ridge means disposed on said upwardly inclined discharge surface extends from a point below the level of liquid contained in said flotation tank to a point above the level of said liquid.

9. A method for the froth flotation separation of the components of a slurry having particulate matter therein which is to be separated and collected, said method comprising the steps of:

(i) spraying an input slurry of particulate matter into a liquid contained in a flotation tank to create a froth on the liquid surface;

(ii) removing the froth from said liquid surface by skimming means, said skimming means passing said froth over a discharge surface, said discharge surface having at least one raised ridge means disposed thereon for preventing the skimming means from contacting the portion of the discharge surface upon which said at least one raised ridge means is disposed and cooperating with said skimming means and discharge surface to separate excess liquid from the froth prior to the collection of the froth.

10. The method according claim 9 wherein said skimming means comprises a plurality of spaced skimmer plates.

11. The method according to claim 9 wherein said particulate matter comprises coal.

12. The method according to claim 9 wherein said particulate matter comprises mineral ore.

* * * * *